US006393800B1

(12) United States Patent
Schwenke

(10) Patent No.: US 6,393,800 B1
(45) Date of Patent: May 28, 2002

(54) APPARATUS FOR SEALING BEVERAGE CONTAINERS BY MEANS OF CAPS

(75) Inventor: Dieter Schwenke, Hamburg (DE)

(73) Assignee: Alfill Engineering GmbH & Co. KG, Hamburg (DE)

( * ) Notice: Subject to any disclaimer, the term of this patent is extended or adjusted under 35 U.S.C. 154(b) by 0 days.

(21) Appl. No.: 09/508,232

(22) PCT Filed: Sep. 3, 1998

(86) PCT No.: PCT/EP98/05586

§ 371 (c)(1),
(2), (4) Date: Mar. 8, 2000

(87) PCT Pub. No.: WO99/12841

PCT Pub. Date: Mar. 18, 1999

(30) Foreign Application Priority Data

Sep. 9, 1997 (DE) ..... 197 39 327

(51) Int. Cl.[7] ..... B65B 7/28
(52) U.S. Cl. ..... 53/329; 53/543
(58) Field of Search ..... 53/471, 485, 329, 53/202, 150, 539, 543, 286, 287; 215/316

(56) References Cited

U.S. PATENT DOCUMENTS 1,300,754 A * 4/1919 Miller ..... 53/329
2,974,455 A * 3/1961 Ravn ..... 53/329
4,947,627 A * 8/1990 Scheidegger ..... 53/557
5,310,300 A * 5/1994 Crabb et al. ..... 53/539
5,749,204 A * 5/1998 Bokelmann et al. ..... 53/471
5,858,141 A * 1/1999 Repp et al. ..... 156/69
6,094,890 A * 8/2000 Michellon et al. ..... 53/453

FOREIGN PATENT DOCUMENTS

| | | |
|---|---|---|
| DE | 2 166 557 | 8/1974 |
| DE | 43 25 843 | 2/1995 |
| DE | 296 16 138 | 11/1996 |
| GB | 969084 | 9/1964 |
| GB | 2773 | 7/1972 |
| WO | WO 91/19666 | 12/1991 |

* cited by examiner

*Primary Examiner*—John Paradiso
(74) *Attorney, Agent, or Firm*—Rankin, Hill, Porter & Clark LLP

(57) ABSTRACT

An apparatus for sealing beverage containers with sealing caps, wherein the apparatus includes a transfer unit to transfer the caps from a single-track cap conveyor onto the bottles and a bottle conveyor on which the bottles are moved in several tracks in parallel rows. The transfer unit accepts the number of caps at the cap conveyor that are required to outfit a row of containers, and moves the caps into target positions above the row of containers. The caps in the target positions are gripped from above by cap carriers and deposited by the cap carriers onto the containers.

10 Claims, 3 Drawing Sheets

APPARATUS FOR SEALING BEVERAGE CONTAINERS BY MEANS OF CAPS

BACKGROUND OF THE INVENTION

Sealing apparatuses are used to automatically seal beverage containers in wineries and must be designed for high outputs of, for instance, 20,000 bottles an hour. Basically, two kinds of such sealing apparatuses are known. In one kind, the caps are first deposited on the containers and then are slightly pressed onto the containers. The caps and containers are then moved to the sealing apparatus proper which, by means of sealing heads, carries out the sealing in either a rotating or a deforming manner depending upon the cap configuration.

For example, screw caps would be rotated to seal and crown caps would be deformed for sealing. In the other design, namely the pick-and-place procedure, the sealing heads grip the caps and move the caps onto the bottles in order to seal the bottles immediately.

Following checks on sorting and positions, the caps are fed on a single-track cap conveyor to the sealing apparatus. A transfer unit accepts the caps from the cap conveyor and moves the caps into the target positions for deposition on the containers. This procedure is implemented by the sealing heads themselves in pick-and-place machines.

As regards known apparatus of the aforementioned type, the containers move on a single track through the sealing apparatus, which typically is rotary. Accordingly, the transfer unit feeds all containers sequentially. Even as regards the known straight-line filling configuration, wherein several bottles in one linear filler are filled simultaneously and then are simultaneously sealed with several sealing heads on one linear sealer, the state of the art provides Single-Track bottle transport from the linear filler to the linear sealer, with the caps being sequentially deposited on the bottles along this single-track transport segment. Because in all known equipment of this type the containers are sequentially fitted with caps, the transfer unit must operate very rapidly. Furthermore the known equipment is restricted to single-track container transport.

SUMMARY OF THE INVENTION

The present invention is directed toward an apparatus of the aforementioned type that operates at a slower rate even during high container flow and which is free of the restrictions accompanying single-track container transport.

In accordance with the present invention, all containers in one row of containers are processed in one transfer operation of the transfer unit. Compared with the known, single-track configuration, the invention, at equal output, provides more time for operating the transfer unit, which thereby may accept the caps and move them into the target positions relatively slowly. Such procedures furthermore may be run in parallel.

The apparatus of the present invention is especially well suited for container processing machinery using parallel container transportation without requiring a number of parallel container tracks as would be required by conventional transfer units. The apparatus of the invention is applicable to depositing such caps as screw caps, crown caps or other sealing caps on bottles of all kinds, for instance plastic bottles. The present invention is also directed toward depositing lids on conventional cans. In special cases, the containers may be empty. Typically, however, the caps are deposited on filled containers that must be sealed.

The caps moved from a transfer unit into a target position may be gripped sequentially or, advantageously, simultaneously by the cap carriers and be deposited on the containers. The simultaneous operation permitted by the present invention permits a simplified design.

The caps may be deposited, for instance, by means of comoving cap carriers on moving containers. However, in accordance with another aspect of the present invention, the rows of containers are moved in timed or synchronized manner and are filled when standing still underneath predetermined target positions.

The cap conveyor may move the caps in different paths to the target positions, for instance moving all required caps on parallel tracks. In accordance with another aspect of the present invention, the transfer unit comprises only one single-track cap conveyor, thereby simplifying the design.

In further accordance with the present invention, many bar drivers are used for mutually transferring the caps and relaying each from target position to target position. This feature offers machinery that operates very precisely and that, on account of constrained conveyance, provides high reliability in reaching the target positions.

In accordance with other aspects of the invention, the caps are moved on a bottom strip which, when the target positions have been reached, are removed from under the caps individually or as a whole. Prior to removing the bottom strip, the cap carriers grip the caps and, following removal of the bottom strip, deposit the caps on the containers. The bottom strip, or segments of the bottom strip, is displaced by a drive means. Alternatively, the bottom strip (or segments thereof) may be designed to be resilient so that the cap carriers, with the caps, press the bottom strip away during the downward motion of the caps. This configuration allows the caps to be gripped by the cap carriers and thereby permits deposition of the caps in a simple downward motion onto the containers. Accordingly, a complex motion of the cap carriers, for instance including gripping the caps, lateral displacement and ensuing deposition motion, is avoided with the present invention.

According to another aspect of the invention, suction tubes are provided to grip the caps from above by suction. The suction tubes deposit the caps on the containers and then slightly press the caps against the containers for securing.

In further accordance with the present invention, the cap carriers may serve as the sealing heads in order to grip the caps by the pick-and-place procedure, to deposit the caps on the containers, and then to immediately seal the caps on the containers. Sealing may be, depending on the type of cap, by screwing, or, in the case of crown caps or can tops, by deformation.

BRIEF DESCRIPTION OF THE DRAWINGS

These and further features of the present invention will be apparent with reference to the following description and drawings, wherein.

DETAILED DESCRIPTION OF THE PREFERRED EMBODIMENTS

Figure 1:
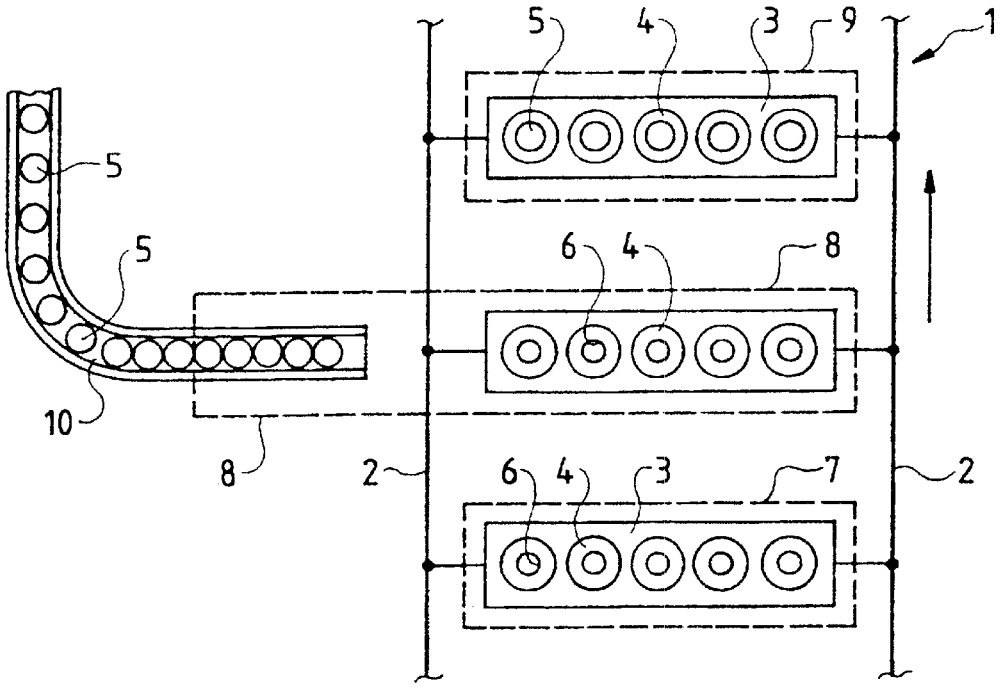
FIG. 1 is a top plan view of a bottle conveyor moving bottles in parallel sets and comprising a cap conveyor and a transfer unit indicated in diagrammatic form.

FIG. 1 illustrates a bottle conveyor 1 that bears bottle carriers 3 between chains 2 moving in the direction of the arrow. Each bottle carrier contains five bottles 4 with mouths 6 that will be sealed by caps 5. Shown in dashed lines are units mounted above the bottle conveyor 1, namely a bottle filling unit 7, a transfer unit 8 and bottle sealing unit 9.

By means of the bottle conveyor 1, the bottles arrive first underneath the bottle filling unit 7 which simultaneously fills a row of bottles. In this embodiment a row of bottles comprises five bottles. Then, the filled bottles arrive underneath the transfer unit 8 where they are fitted with caps and then are moved to the bottle sealing unit 9 where the caps 5 already deposited on the bottles are sealed by five parallel sealing heads. Sealing occurs, depending on the type of cap, either by rotating the cap into a tight screw fit or by deforming the cap.

The caps 5 are fed by means of a cap conveyor 10 on a single track to the transfer unit 8. Accordingly, the transfer unit 8 receives the caps from the cap conveyor 10, and moves the caps into the target positions above the row of bottles. The transfer unit 8 then deposits the caps onto the bottles.

Figure 2:
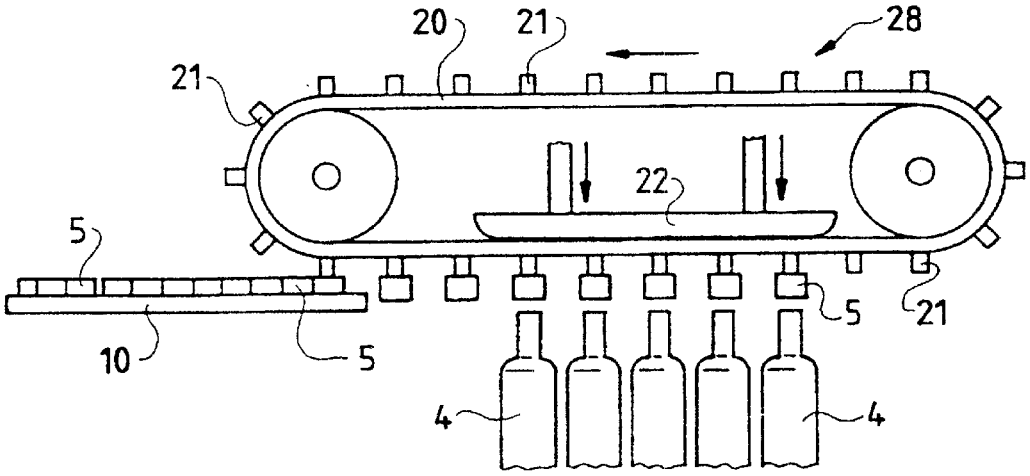
FIG. 2 is an elevational view, in the direction of bottle motion, of a transfer unit with an endless conveyor belt.

FIG. 2 shows an embodiment of the transfer unit 28 comprising an endless conveyor belt 20 revolving about end rollers. Cap carriers 21 are mounted to the belt 20 at a distance from the bottles 4 and in the bottle carriers 3 (not shown in FIG. 2). The caps 5 arrive on the cap conveyor 10 of FIG. 1, then they are sequentially gripped by the cap carriers 21 as the conveyor belt 20 runs in the direction of the arrow and moved into position above the bottles 4. At this point the caps are forced down by a descending actuator 22 and deposited on the bottles 4.

The cap carriers 21 may hold the caps magnetically or mechanically with clamps (not shown). However, the cap carriers may also be tubular in the form of suction tubes to which a vacuum is applied through the conveyor belt 20 which, in turn, is connected to a vacuum source (not shown).

In another design, the cap carriers 21 are supported in a sliding manner on the conveyor belt 20. Accordingly, the cap carriers are forced down by the actuator 22 relative to the conveyor belt 20, which remains at constant elevation.

In the target position, the cap carriers 21 are situated above the bottles 4 and also may be lowered sequentially on the bottles 4. Therefore, the actuator 22 is made displaceable above the row of bottles 4 so as to sequentially force downward the cap carriers 21.

FIGS. 3*a* through 3*d* show a second embodiment of a transfer unit 38 again receiving the caps 5 from the cap conveyor 10. The caps 5 rest on a slender bottom strip 30 which first runs straight underneath the cap conveyor 10 and then in semi-circles alternating to the left and right and lastly terminates in an actuation end 30'. Vertical shafts 31 fitted in bearings (not shown) are situated at the centers of the semi-circles. Drivers 32 in the form of bars and a driver 32' of somewhat different geometry are affixed to the shafts. The shafts 31 are driven in opposite directions as indicated by arrows in FIG. 3*a*.

Figure 3A:
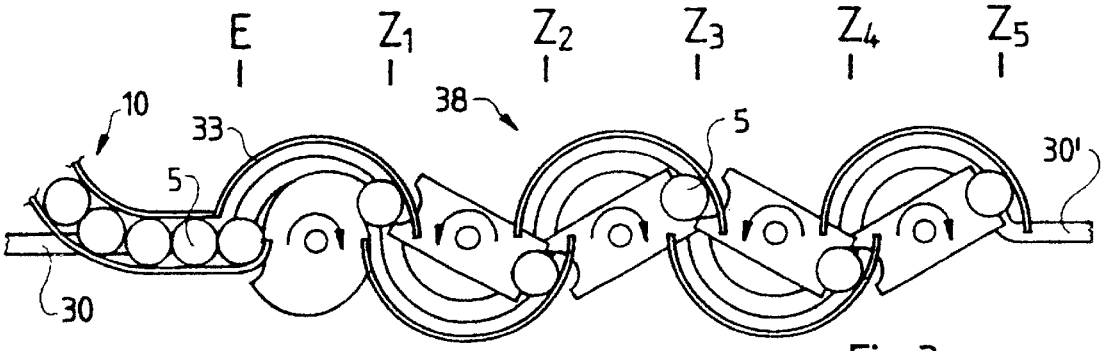
FIGS. 3*a*–3*c* are top plan views, in the direction of bottle motion, of a transfer unit.
Figure 3B:
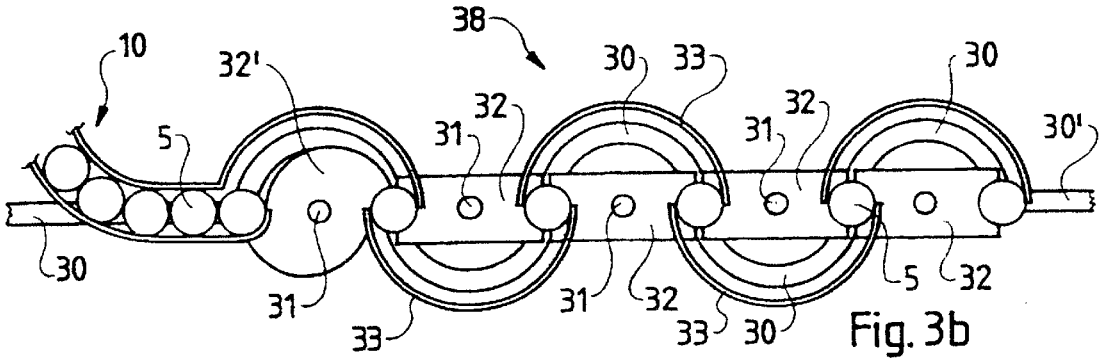
Figure 3C:
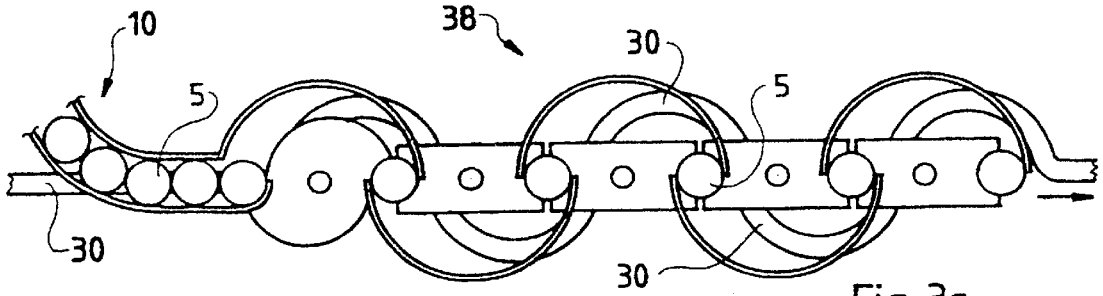

As shown by FIGS. 3*a* through 3*c*, the drivers 32 and 32' are fitted with clearances to grip the caps 5 and to move each over the semi-circular paths above the bottom strip 30 when the drivers are actuated. Each of the semi-circular paths are made secure externally by semi-circular railings 33 to provide clean cap guidance at the railing 33, on one hand, and within a recess of the particular driver 32, 32', on the other hand.

Figure 3D:
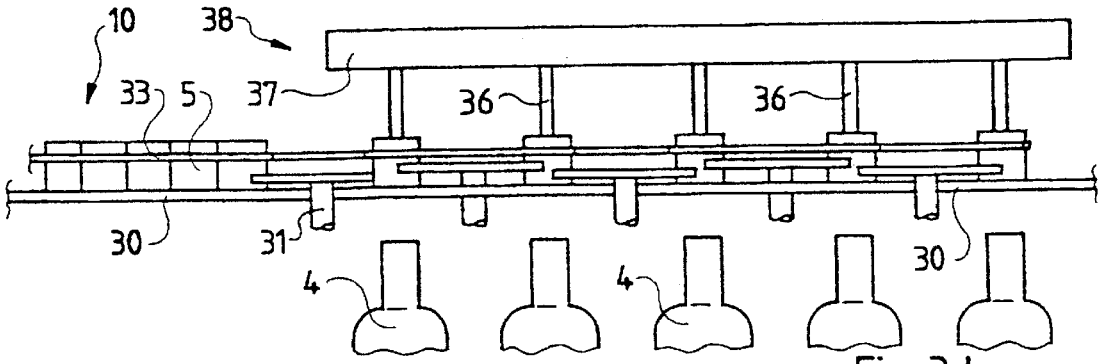
FIG. 3*d* is an elevational view, in the direction of bottle motion, of a transfer unit relaying the caps from target position to target position.

FIG. 3*a* shows the positions. The first driver 32', upon being rotated by 180°, accepts a cap from the terminal E of the cap conveyor 10 and transfers the cap to the first target position $Z_1$. At the first target position $Z_1$, as shown by FIG. 3*a*, the cap is gripped by the recess in the next driver 32 and is transferred by the next driver 32 to the target position $Z_2$. In this manner the caps are sequentially transferred from target position to target position and from driver to driver until all target positions have been filled. Thereafter, the drivers are actuated into the position shown in FIG. 3*b*, as a result of which the caps 5 are arrayed exactly in a row in the target position above the bottles 4, as shown in FIG. 3*d*. Then, the bottom strip 30 is displaced underneath the arcuate guide path secured by the railings 33 toward the actuator end 30', that is, from the position shown in FIG. 3*b* into the position shown in FIG. 3*c*. Henceforth, the caps 5 in the target positions $Z_1$ and $Z_5$ are free to move in the downward direction.

Before the bottom strip 30 is moved sideways from the position of FIG. 3*b* into that of FIG. 3*c*, the cap carriers 36, which are illustratively shown in FIG. 3*d* in the form of suction tubes, grip the caps 5 and hold the caps while the bottom strip 30 is moved laterally. Next, by means of the downward motion of a beam 37 holding all cap carriers 36, all caps are deposited on the bottles 4.

Figure 4:
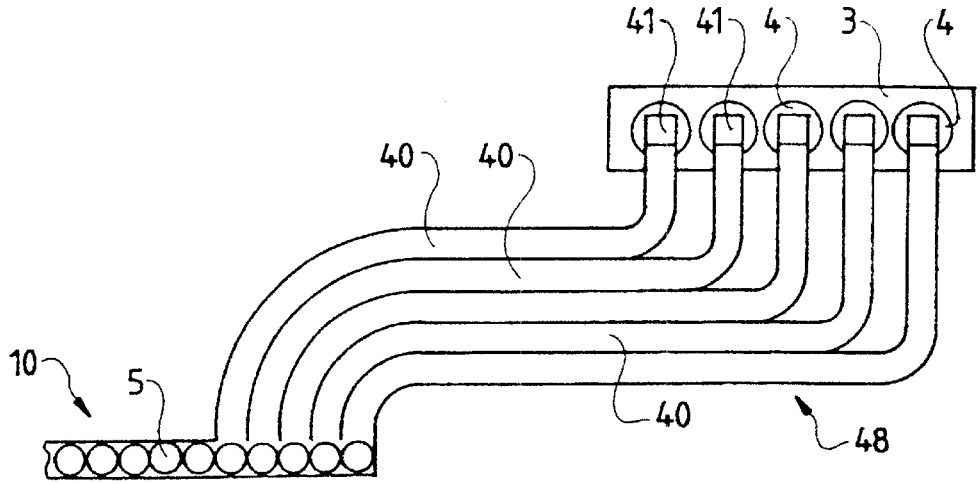
FIG. 4 is a top plan view of a transfer unit with parallel conveyance of caps from the cap conveyor to the target positions.

FIG. 4 shows another embodiment of a transfer unit 48 moving the caps 5 from the cap conveyor 10 above the bottles 4 in a bottle carrier 3 shown in FIG. 1.

Several conveyor tracks 40 issue sideways from an end zone of the cap conveyor 10 and terminate at the target positions above the bottles 4. The illustrated conveyor tracks 40 are self-conveying. They may be troughs guiding the caps 5 and be fitted with air jets moving the caps on the individual conveyor track 40. The bottom strip of each conveyor track 40 is a valve 41 in the target position.

The cap conveyor 10 moves the required number of five caps (in this embodiment) in front of the beginnings of the conveyor tracks 40. By means of these tracks 40, the caps arrive in the target positions on the valves 41. Omitted cap carriers (i.e., suction tubes) grip the caps 5 resting on the valves 41 and hold them. Next, the valves 41 are flipped away or yield resiliently in a downward path, whereby the cap carriers downwardly deposit the caps 5 on the bottles 4.

The conveyance tracks 40 may be configured in substantially arcuate manner as shown or they may fan out obliquely between their particular ends.

Figure 5:
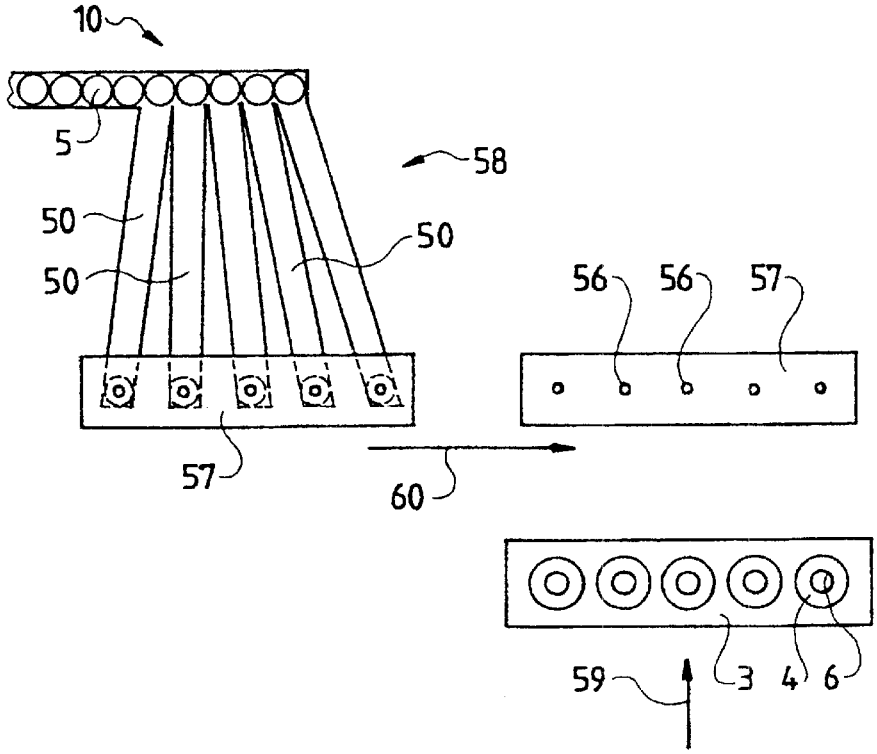
FIG. 5 is a top plan view of a transfer unit comprising a transfer beam moving the mutually spaced caps into the target positions.

FIG. 5 shows another embodiment of a transfer unit 58 receiving caps 5 in parallel from the cap conveyor 10. The transfer unit is fitted with conveyance tracks 50 that may be configured similarly to the conveyance tracks 40 of the embodiment shown in FIG. 4. The transfer unit moves the caps so that, at the ends of the conveyance tracks 50, the caps are arrayed in a row at intermediate positions in which they can be gripped by cap carriers 56 seated on a beam 57. The beam 57 may be designed like the beam 37 illustrated in FIG. 3*d*.

After all caps at the ends of the conveyance tracks 50 have been gripped, the beam 57 is moved in the direction of the arrow 60 into path of a bottle carrier 3 (as in FIG. 1). The bottle carrier 3 moves in the direction of the arrow 59 as far as underneath the beam 57. Thereafter, the beam 57 together with the cap carriers 56 may be lowered and the caps can be made to descend on the mouths 6 of the bottles 4.

In the above embodiments, the containers were shown being moved while resting on their bottom strips. However, and especially as regards plastic bottles fitted with neck hooks, they also may be moved while suspended from correspondingly designed bottle conveyors.

What is claimed is:

1. An apparatus to seal beverage containers (4) by means of sealing caps (5), comprising a transfer unit (8, 28, 38, 48, 58) to transfer caps from a single-track cap-conveyer (10) to the containers, wherein the containers (4) are moved by a container conveyor in several tracks in parallel-rows and wherein the transfer unit (8, 28, 38, 48, 58) is configured to accept a number of caps (5) at the cap conveyor (10) that is required to supply a row of containers, and wherein the transfer unit moves the caps into target positions above individual containers (4) of the row of containers by means of cap carriers (21, 36, 56), said cap carriers gripping said caps from above at the target positions ($Z_1$, $Z_2$, $Z_3$, $Z_4$, $Z_5$) and depositing the caps on the containers (4).

2. The apparatus as claimed in claim 1, wherein all the caps (5) in the target positions are synchronously gripped and deposited.

3. The apparatus as claimed in claim 1, wherein the row of containers and the target positions ($Z_1$, $Z_2$, $Z_3$, $Z_4$, $Z_5$) are stationary while deposition takes place.

4. The apparatus as claimed in claim 1, wherein the cap conveyor of the transfer unit (28, 38) moves the caps in a single track parallel to a direction of the container rows from the cap conveyor (10) to above the containers (4).

5. The apparatus as claimed in claim 4, wherein the cap conveyor is an endless conveyor belt (20) fitted with cap carriers (36) affixed in the same spaced relation as the containers (4) in the container row said cap carriers being adapted to accept the caps (5) from the cap conveyor (10).

6. The apparatus as claimed in claim 4, wherein the cap conveyor transfers the caps on a guide track fitted with drive means (32, 32') between which the caps (5) are relayed from the cap conveyor (10) to the first target position ($Z_1$) and between the target positions ($Z_1$, $Z_2$, $Z_3$, $Z_4$, $Z_5$).

7. The apparatus as claimed in claim 6, wherein the guide track between the target positions ($Z_1$, $Z_2$, $Z_3$, $Z_4$, $Z_5$) is semi-circular on alternating sides, and the drive means (32, 32') is pivotably supported about the centers of the semi-circles.

8. The apparatus as claimed in claim 4, wherein the caps (5) in the cap conveyor run along a bottom (30, 40), said bottom being removable at least from the target positions ($Z_1$, $Z_2$, $Z_3$, $Z_4$, $Z_5$), cap carriers (36) being mounted in a vertically driven manner above said target positions.

9. The apparatus as claimed in claim 1, wherein the cap carriers (21, 36, 56) are suction tubes.

10. The apparatus as claimed in claim 1, wherein the cap carriers (21, 36, 56) are sealing heads.

* * * * *